United States Patent [19]

Shin et al.

[11] Patent Number: 4,832,086

[45] Date of Patent: May 23, 1989

[54] INSERTION CONTROLLER FOR ALTERNATE WEAVING WITH DIFFERENT WEFTS ON A FLUID JET LOOM

[75] Inventors: Tokujiro Shin, Matsutou; Yoshio Ida, Mikuni; Koyu Maenaka, Matsutou, all of Japan

[73] Assignee: Tsudakoma Kogyo Kabushiki Kaisha, Japan

[21] Appl. No.: 125,157

[22] Filed: Nov. 25, 1987

[30] Foreign Application Priority Data

Jun. 11, 1987 [JP] Japan ..... 62-146526

[51] Int. Cl.[4] ..... D03D 47/30

[52] U.S. Cl. ..... 139/435; 139/453

[58] Field of Search ..... 139/435, 450, 452, 453

[56] References Cited

U.S. PATENT DOCUMENTS 3,706,072 12/1972 Greenley et al. .
4,366,689 1/1983 Yajima .
4,646,791 3/1987 Tsuji ..... 139/435
4,651,785 3/1987 Volland et al. ..... 139/435
4,658,865 4/1987 Gotoh ..... 139/435
4,673,004 6/1987 Rosseel et al. ..... 139/435
4,703,778 11/1987 Wulf ..... 139/435

FOREIGN PATENT DOCUMENTS 0114339 8/1984 European Pat. Off. .

*Primary Examiner*—Henry S. Jaudon
*Attorney, Agent, or Firm*—Ostrolenk, Faber, Gerb & Soffen

[57] ABSTRACT

In construction of an insertion controller for a fluid jet loom in which a driver circuit controls the sequence of weft insertion following a regular sequential weft insertion pattern given by an automatic weft selector, a free selective weft selection by a manual weft selector is introduced for free and easy adjustment of weft insertion with provisional reservation of the regular sequential weft selection pattern.

5 Claims, 9 Drawing Sheets

Figure 1:
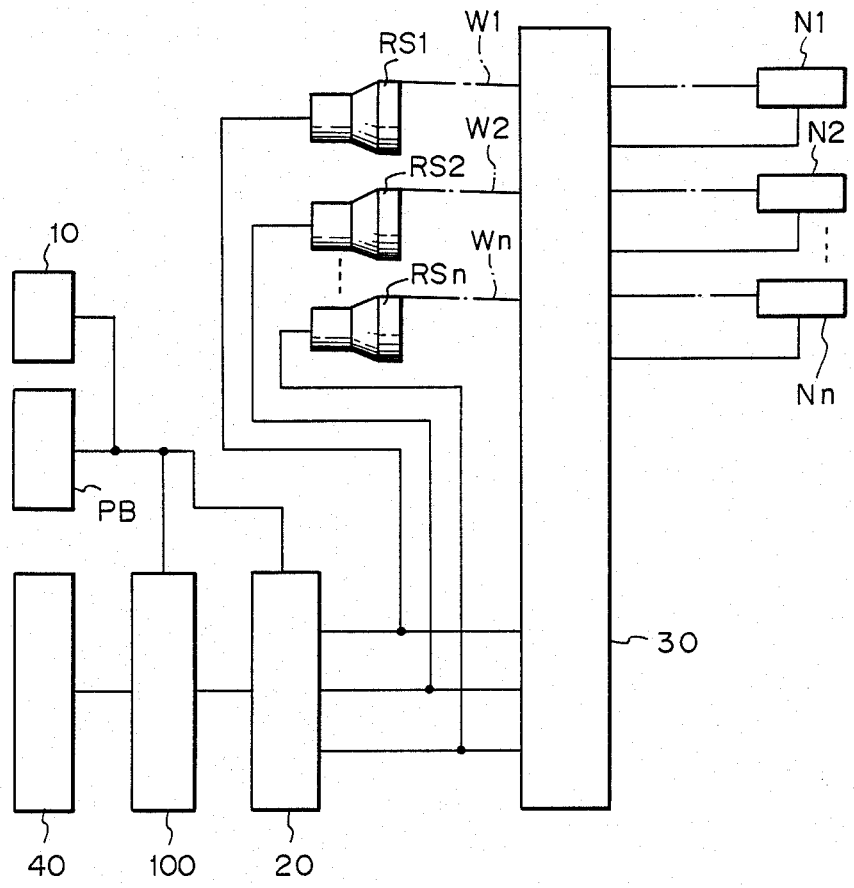

10
201
P
221
202
PB1
B1
PB2
211
203
B2
PBn
Bn
204
20
231
30
225
Q
33
40
21
214
23
22
C1
G1
222
215
24
31
26
32
28
I
I
G2
27
25
II
II
C2
223
n
n
Cn
Gn
224
11

INSERTION CONTROLLER FOR ALTERNATE WEAVING WITH DIFFERENT WEFTS ON A FLUID JET LOOM

The present invention relates to an insertion controller for alternate weaving with different wefts on a fluid jet loom, and more particularly relates to an improvement in a weft insertion control system for alternate weaving with different wefts on a fluid jet loom on which different wefts are inserted into sheds following a regular sequential weft selection pattern via different main nozzles by sequential drive of a weft inserting unit in accordance with commands from an automatic weft selector.

In the case of the above-described type of fluid jet loom, weft insertion is carried out following the regular sequential weft selection pattern fixed by the commands given by the automatic weft selector and no particular problem occurs in this mode of weaving as long as the loom performs its normal running.

At stoppage of the loom, however, it is sometimes required to perform weft insertion in a sequence independent of the regular sequential weft insertion pattern fixed by the commands from the automatic selector for the purpose of, for example, repair of weft defects on any main nozzles. With the conventional weft selection system, however, such a free weft insertion is quite infeasible because the sequence of weft insertion is exclusively fixed by the commands from the automatic weft selector. Thus, repair of weft defects cannot be duly performed in the case of fluid jet looms equipped with such a conventional weft selection system.

It is the first object of the present invention to enable free weft insertion, at stoppage of loom, in a sequence independent of a regular sequential weft insertion pattern fixed by commands from an automatic weft selector without adversely affecting such a fixed pattern.

In accordance with the first aspect of the present invention, a signal reservation circuit is interposed between an automatic weft selector and a driver circuit, a control box of the loom and a manual weft selector are connected to the signal reservation circuit and to the driver circuit, the driver circuit is made to operate following a regular sequential weft selection pattern fixed by commands from the automatic weft selector during normal running of the loom, and, at stoppage of the loom, the driver circuit is made to operate following a free selective weft selection pattern fixed by commands from the manual weft selector with priority to the regular sequential weft selection pattern.

In practical alternate weaving with different weft, it is sometimes required to intercept the regular sequential weft selection pattern during normal running of the loom for adjustment of weft insertion, in addition to the above-described sequence interception at stoppage of the loom. Such adjustment includes adjustment in, for example, fluid pressure, timing of fluid ejection, position of the nozzles and other process factors influencing the state of weft insertion.

In the case of ordinary weaving with same wefts, such adjustment can be carried out quite easily. For example, a stroboscope may be used for measurement of the state of weft insertion. In the case of alternate weaving with different wefts, a number of wefts different in type are inserted following a regular sequential weft selection pattern and, as a consequence, it is quite impossible to measure the state of weft insertion of a particular weft repeatedly in succession.

Japanese Utility Model Opening Sho. 62-114080 proposes a system to perform such a measurement even in the case of alternate weaving. In the case of this earlier proposal, a stroboscope is activated in synchronism with insertion of a particular weft only in order to selectively measure the state of weft insertion of that particular weft. When alternate weaving is carried out following a given regular sequential weft selection pattern, some wefts may appear in sheds at short intervals and some wefts may appear in sheds at long intervals. Thus, depending on the selection pattern, the wefts of long intervals require a long time for measurement of their state of weft insertion. For these reasons, the system of the earlier proposal is unsuited for measurement of the state of weft insertion following some types of regular sequential weft selection patterns.

In the case of the insertion controller in accordance with the first aspect of the present invention, shift in weft selection mode, that is from the regular sequential to the free selective weft selection pattern, is caused depending on the state (H/L) of the output signal from the control box of the loom. So, the free selective weft selection can be introduced only at stoppage of the loom when the output signal is at the H-level.

For introduction of the free selective weft selection during normal running of the loom, one known method is to replace a regular sequential weft selection pattern in the memory with a free selective weft selection pattern. After adjustment of weft insertion, the free selective weft selection pattern in the memory may be again replaced by the initial regular sequential weft selection pattern. However, this system entails considerable time and effort for adjustment of weft insertion.

It is the second object of the present invention to enable free weft insertion, regardless of the running condition of the loom, in a sequence independent of a regular sequential weft insertion pattern fixed by commands from an automatic selector for the purpose of adjustment weft insertion at any time required.

In accordance with the second aspect of the present invention, a signal reservation circuit is interposed between an automatic weft selector and a driver circuit, a manual weft selector is connected to the signal reservation circuit and to the driver circuit, and, when commands are issued from the manual weft selector, the driver circuit is made to operate following a free selective weft selection pattern fixed by these commands with priority to the regular sequential weft selection pattern fixed by commands from the automatic weft selector.

Figure 2:
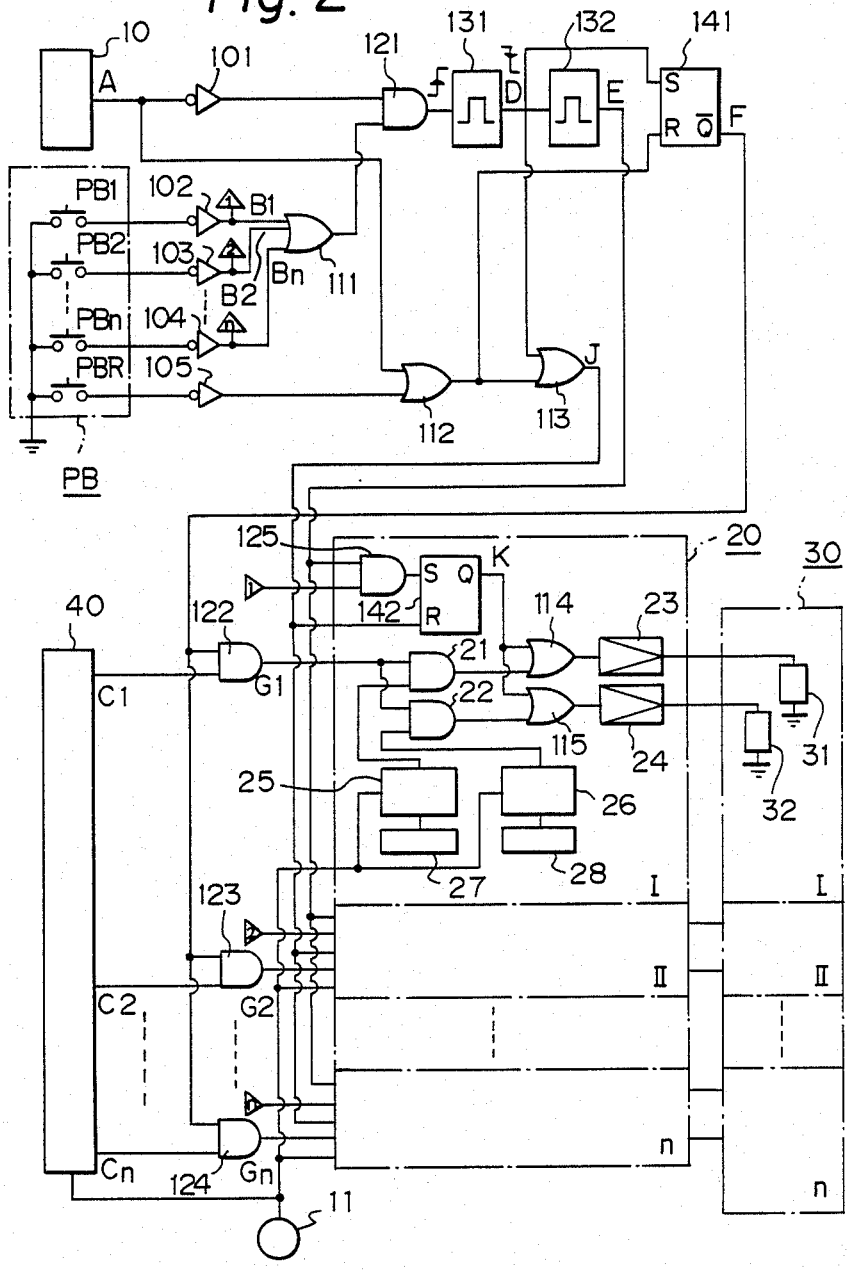
Figure 3:
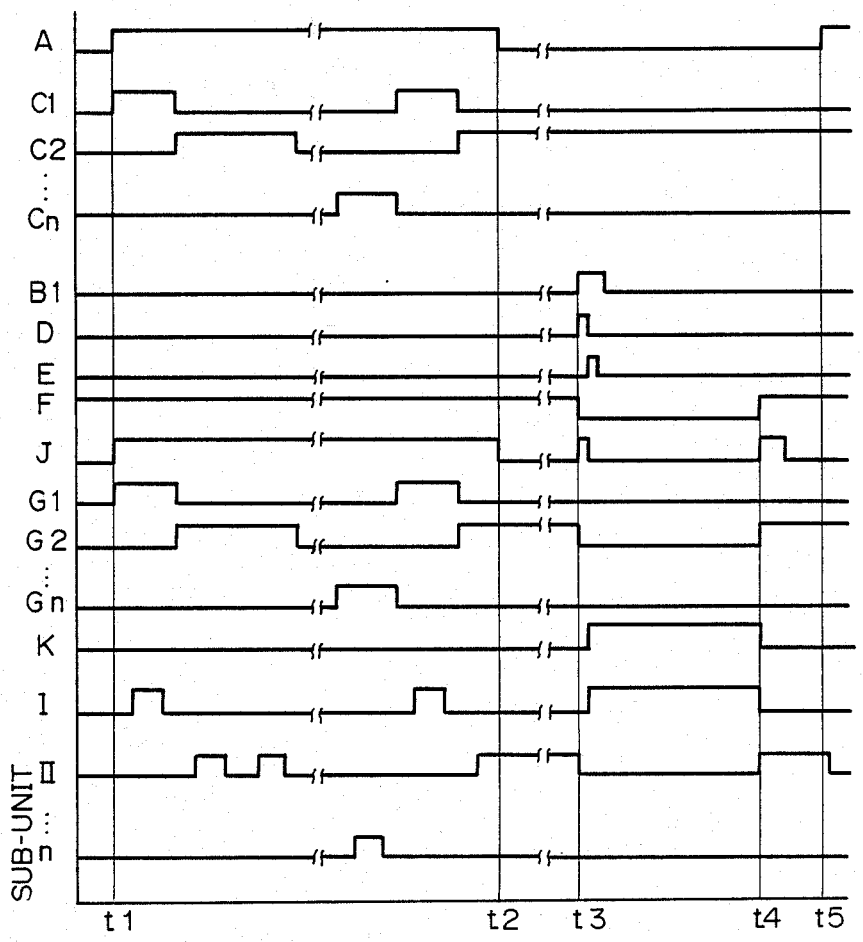
Figure 4:
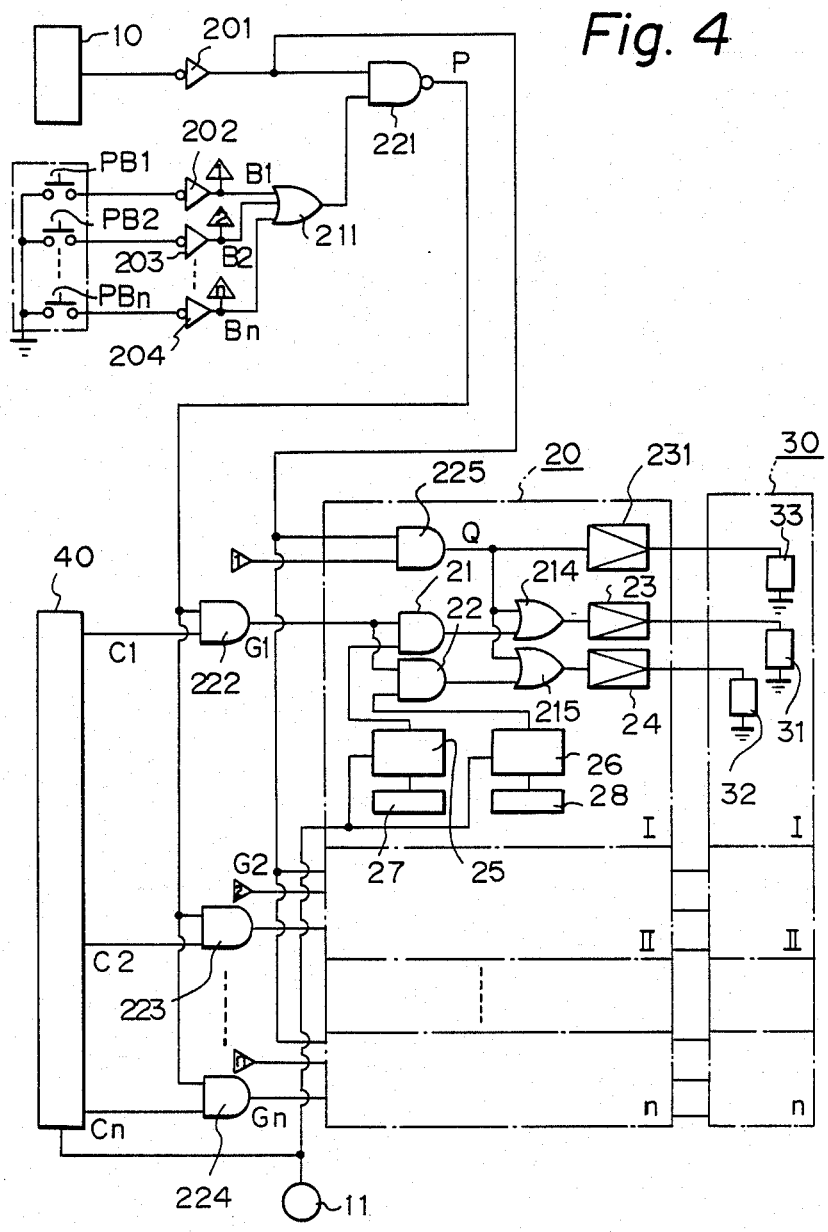
Figure 5:
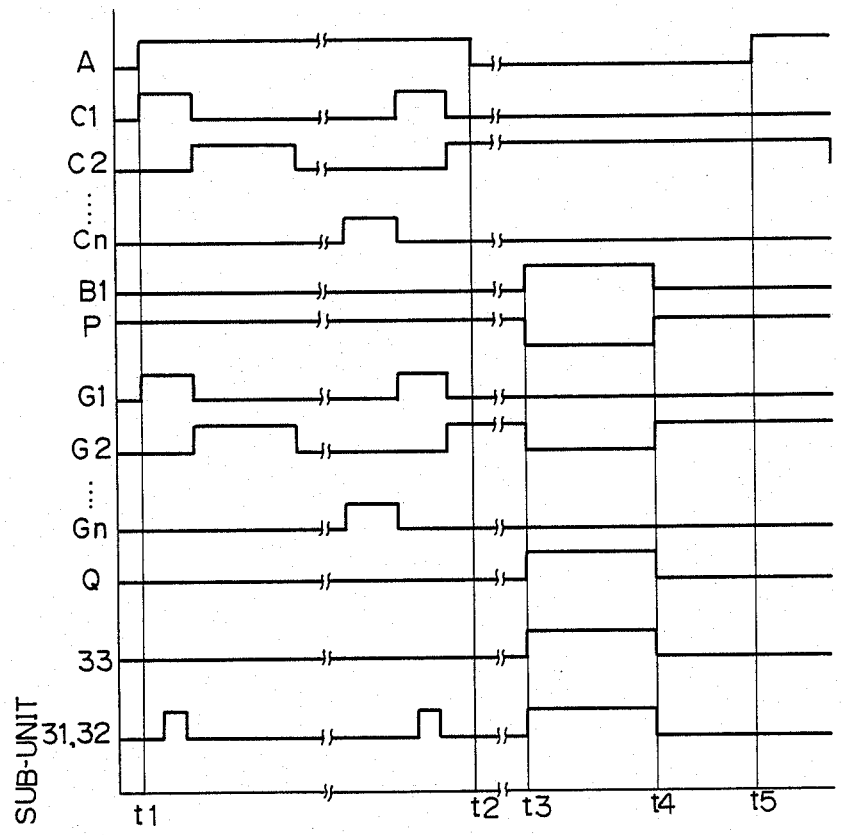
Figure 6:
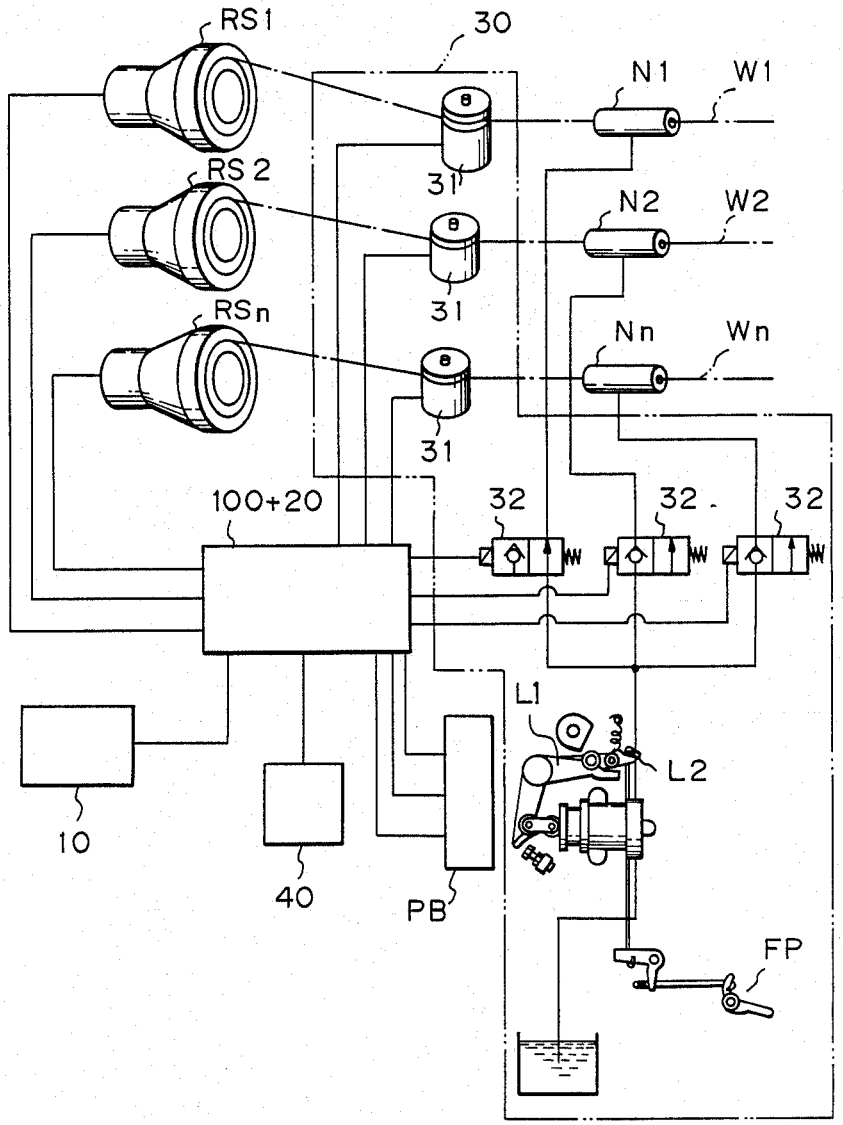
Figure 7:
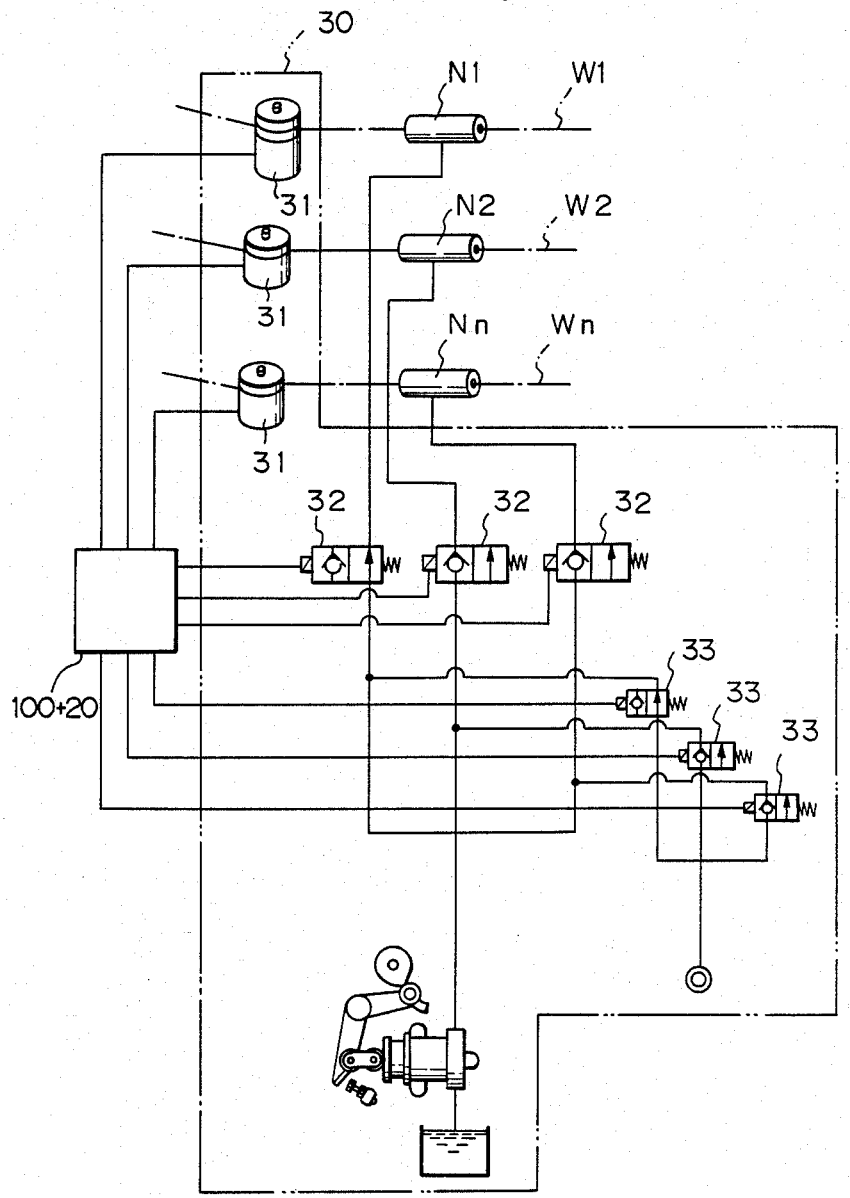
Figure 8:
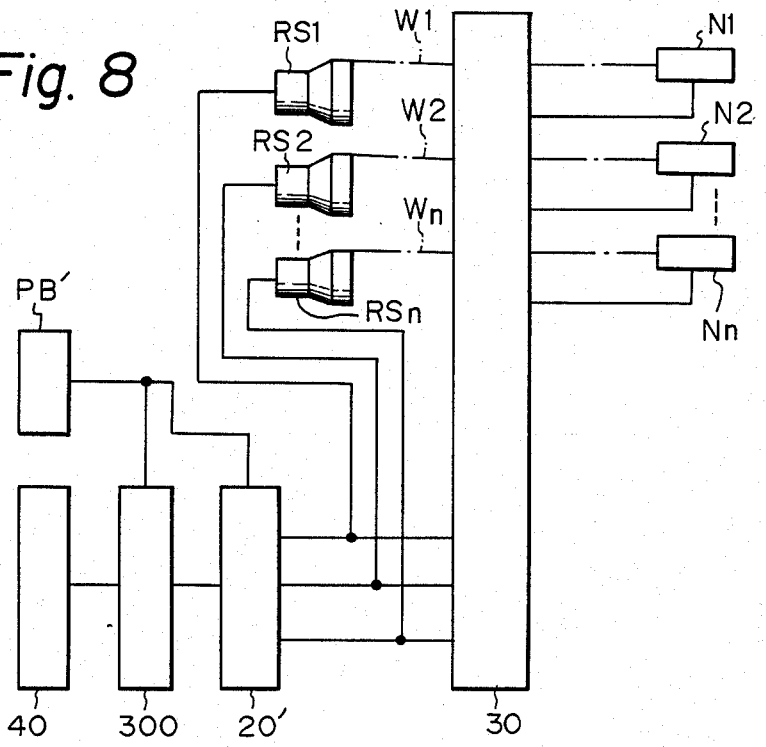
Figure 9:
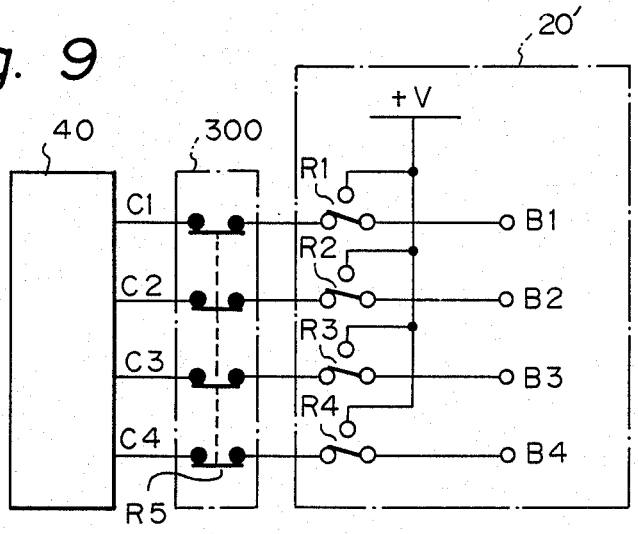
Figure 10:
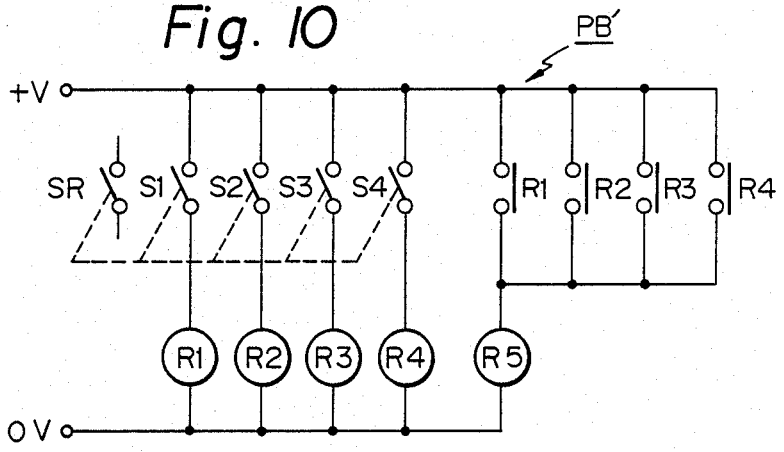
Figure 11:
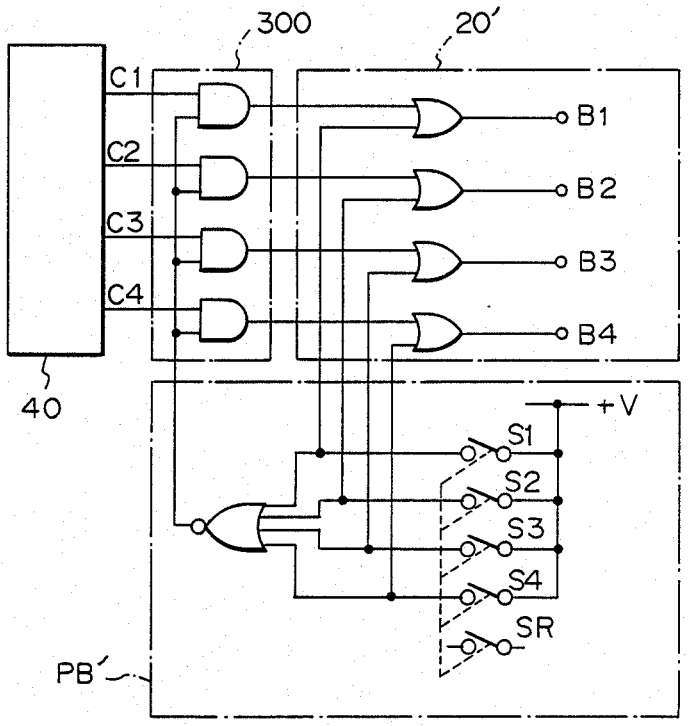

The present invention will next be explained in more detail in reference to the accompanying drawings, in which FIG. 1 is a block diagram of the general construction of a weft inserting system on a fluid jet loom incorporating the insertion controller in accordance with the first aspect of the present invention, FIG. 2 is a block diagram of one embodiment of the detailed construction of the weft inserting system shown in FIG. 1, FIG. 3 is a timing chart of the operation of the controller having the construction shown in FIG. 2, FIG. 4 is a block diagram of another embodiment of the detailed construction of the weft inserting system shown in FIG. 1, FIG. 5 is a timing chart of the operation of the controller having the construction shown in FIG. 4, FIGS. 6 and 7 are schematic views of some examples of the weft inserting unit used for the controllers shown in FIGS. 2 and 4, FIG. 8 is a block diagram of the general construction of a weft inserting system on a fluid jet loom incorporating the insertion controller in accordance with the second aspect of the present invention, FIGS. 9 and 10 are block diagrams of one embodiment of the detailed construction of the weft inserting system shown in FIG. 8, and FIG. 11 is a block diagram of another embodiment of the detailed construction of the weft inserting system shown in FIG. 8.

FIG. 1 shows the general construction of a weft inserting system on a fluid jet loom incorporating the insertion controller in accordance with the first aspect of the present invention.

As is conventional ones, the system includes a driver circuit 20, a weft inserting unit 30 electrically connected to the driver circuit 20 and an automatic weft selector 40. A signal reservation circuit 100 is interposed between the automatic weft selector 40 and the driver circuit 20. A control box 10 and a manual weft selector PB are electrically connected to the signal reservation circuit 100 and to the driver circuit 20. The driver circuit 20 is also electrically connected to weft reservoirs RS1 to RSn. By operation of the weft inserting unit 30, wefts W1 to Wn are sequentially delivered from the weft reservoirs RS1 to RSn in order to be inserted into corresponding sheds via main nozzles N1 to Nn which are hydraulically connected to the weft inserting unit 30 in a known manner.

FIG. 2 shows one embodiment of the detailed construction of the weft inserting system shown in FIG. 1. The control box 10 issues a two-value signal A which assumes a H-level during normal running and a L-level at stoppage of the loom. This control box 10 is connected on one hand to one input terminal of an AND-gate 121 via an inverter 101 and on the other hand to one input terminal of an OR-gate 112.

The manual weft selector PB includes n sets of push buttons PB1 to PBn and a reset push button PBR, n corresponding to the number of the main nozzles N1 to Nn, i.e. the number of the different wefts W1 to Wn. When one button is pushed, a signal of L-level is issued on its corresponding line. The push buttons PB1 to PBn are connected one hand to the input terminal of an OR-gate 111 via respective inverters 102 to 104 and, on the other hand, to the input side of the driver circuit 20 in series therewith. The reset push button PBR is connected to the other terminal of the OR-gate 112.

The AND-gate 121 is connected to a one-shot circuit 131 which issues an output signal D. The one-shot circuit 131 is connected to the S-terminal of a flip-flop circuit 141 and to a one-shot circuit 132 which issues an output signal E. The one-shot circuit 131 is further connected to one input terminal of an OR-gate 113 which issues an output signal J. The one-shot circuit 132 is connected to the driver circuit 20 as later described in more detail.

The OR-gate 112 is connected on one hand to the R-terminal of the flip-flop circuit 141 and, on the other hand, to the other input terminal of the OR-gate 113. The OR-gate 113 is also connected to the driver circuit 20. The flip-flop circuit 141 is connected to the driver circuit 20 and issues an output signal F.

The automatic weft selector 40, which issues output signals (color signals) C1 to Cn, includes n sets of weft selections. The automatic weft selector 40 is connected, in parallel, to the driver circuit 20 via AND-gates 122 to 124 which issue output signals G1 to Gn. The above-described flip-flop circuit 141 is also connected to the AND-gates 122 to 124.

The driver circuit 20 includes n sets of similar drive units for the wefts W1 to Wn, with only the drive unit I being illustrated in FIG. 2.

The drive unit I includes an AND-gate 125 whose input terminal is connected to the one-shot circuit 132 and the push button PB1. The AND-gate 125 is connected to the S-terminal of a flip-flop circuit 142 which issues an output signal K. The R-terminal of this flip-flop circuit 142 is connected to the OR-gate 113.

The AND-gate 121 is connected, in parallel, to one input terminals of AND-gates 21 and 22 whose output terminals are connected, respectively, to setters 27 and 28 via comparators 25 and 26. An encoder 11 on the main shaft of the loom is connected to the comparator 25 and 26 for detection of angle of shaft rotation. The angle of shaft rotation is compared with the weft inserting period set by the setters 27 and 28 for issue of H-level signals from the comparators 25 and 26 during weft insertion. The Q-terminal of the flip-flop circuit 142 is connected to one input terminals of OR-gate 114 and 115. The other input terminals of the OR-gates 114 and 115 are connected to the AND-gates 21 and 22.

The weft inserting unit 30 includes n sets of similar sub-units for the wefts W1 to Wn, only the sub-unit I being illustrated in FIG. 2.

The sub-unit I includes a gripper 31 connected to the OR-gate 114 via an amplifier 23 and an electromagnetic valve 32 connected to the OR-gate 115 via an amplifier 24.

The operation of the controller shown in FIG. 2 will next be explained in reference to FIG. 3, in which time is indicated on the abscissa.

When no weft insertion is performed during normal running (a period from t1 to t2) of the loom, a signal A of L-level is issued by the control box 10. At the weft insertion cycle of the weft W1, the color signal C1 assumes a H-level, the output signals B1 to Bn all assume L-level and, as a consequence, the output signal F from the flip-flop circuit 141 assumes a H-level. As a result, the output signal G1 from the AND-gate 122 assumes a H-level. However, since no weft is to be inserted and the output signals from the comparators 25 and 26 both assume L-levels, the weft inserting unit 30 does not operate at all and no weft is inserted.

Next, it is assumed that the weft W1 is to be inserted following a command given by the automatic weft selector 40 during normal running of the loom. In this case, the color signal C1 assumes a H-level, the output signal F from the flip-flop circuit 141 assumes a H-level and, as a consequence, the output signal G1 from the AND-gate 122 assumes a H-level. Since a weft is to be inserted, the output signals from the comparators 25 and 26 both assume H-levels. Thus, the OR-gate 114 and 115 both issue output signals of H-level to activate the sub-unit I of the weft inserting unit 30. Under this condition, the color signals C2 to Cn all assume L-levels and the output signals G2 to Gn all assume L-levels so that the sub-units II to n do not operate.

When the manual weft selector PB is not yet operated during stoppage (a period from t2 to t5) of the loom, the output signal A from the control box 10 assumes a L-level. Provided that only the color signal C2 assumes a H-level at this very moment, the output signal F assumes a H-level whereas the output signal J assumes a L-level. Thus, only the output signal G2 from the AND-gate 123 assumes a H-level. When the angle of shaft rotation of the loom is just in the weft inserting period set by the setters 27 and 28 in the drive unit II of the driver circuit 20, the sub-unit II of the weft inserting unit 30 is put under an operable condition.

Assuming the push button PB1 of the manual weft selector PB is depressed for practice of, for example, repair of weaving defects, the output signal B1 from the manual weft selector PB assumes a H-level and the output signal F from the flip-flop 141 assumes a L-level. As a result, the output signal G2 from the AND-gate 123 is made to assume a L-level and only the output signal K from the flip-flop circuit 142 of the drive unit I assumes a H-level. As a result, only the sub-unit I of the weft inserting unit 30 is put under an operable condition and the weft W1 is passed to the main nozzle N1 by means of a proper manual operation such as depression of a foot pedal. In this case, the regular sequential weft selection pattern fixed by the commands from the automatic weft selector 40 is provisionally ignored and reserved at the signal reservation circuit 100.

After repair of weaving defect is over, the reset push button PBR is depressed, for example at a moment t4, and the output signal J assumes a H-level. The output signal F from the flip-flop circuit 141 assumes a H-level, the output signal G2 from the AND-gate 123 assumes a H-level and, as a consequence, the output signal K from the flip-flop circuit 142 assumes a L-level. Thus, the sub-unit I is deactivated and the sub-unit II is activated in the weft inserting unit 30. As a result, at restart of the normal running of the loom at a moment t5, the regular sequential weft selection pattern fixed by the commands from the automatic weft selector 40 is resumed for insertion of the weft W2.

FIG. 4 shows another embodiment of the detailed construction of the weft inserting system shown in FIG. 1. Although basically the same as the foregoing embodiment, this construction is different in the following aspects. (I) When one of the push buttons PB1 to PBn is depressed in the manual weft selector PB, a corresponding sub-unit in the weft inserting unit 30 is kept in operation during the period of depression only. As a consequence, no reset push button is needed. (II) An inverter 201 and an OR-gate 211 are connected to the driver circuit 20 only via an AND-gate 221. (III) The inverter 201 is also directly connected to the driver circuit 20 in parallel to the connection in (II). (IV) Each sub-unit in the weft inserting unit 30 includes an auxiliary electromagnetic valve 33 in addition to the gripper 31 and the electromagnetic valve 32. (V) An AND-gate 225 is connected to the auxiliary electromagnetic valve via an amplifier 231. (VI) The AND-gate 225 is also directly connected to OR-gates 214 and 215.

The operation of this weft inserting system is shown in FIG. 5 in which time is again indicated on the abscissa. The loom runs normally during a period from t1 to t2 and is at stoppage during a period from t2 to t5. In the case of the illustrated example, the push button PB1 is depressed during a period from t3 to t4.

Some details of the construction the weft inserting unit 30 of the foregoing embodiments are shown in FIGS. 6 and 7. In these cases, water is used for fluid ejection. For example in FIG. 6, a lever L2 is pivoted to a shaft in connection with a foot pedal FP. During normal running of the loom, the lever L2 is placed outside operative zone of a lever L1. When the foot pedal FP is depressed, the lever L2 lowers and a roller carried thereby pushes down one end of the lever L1 for suction by pumping. When depression on the foot pedal FP is removed, the lever L2 resumes its initial position via spring force for ejection by pumping (ejection of water).

Needless to say, the above-described controllers are similarly usable for a weft inserting system on an air jet loom too.

FIG. 8 shows the general construction of a weft inserting system on a fluid jet loom incorporating the insertion controller in accordance with the second aspect of the present invention. A signal reservation circuit 300 is interposed between an automatic weft selector 40 and a driver circuit 20' and a manual weft selector PB' is connected to the signal reservation circuit 300 and to the driver circuit 20'. The driver circuit 20' is electrically connected to a weft inserting unit 30 and weft reservoirs RS1 to RSn. By operation of the weft inserting unit 30, wefts W1 to Wn are sequentially delivered from the weft reservoirs for insertion via main nozzles N1 to Nn which are hydraulically connected to the weft inserting unit 30 in a known manner.

FIGS. 9 and 10 show one embodiment of the detailed construction of the weft inserting system shown in FIG. 8. In the following description, it is assumed that four types of different wefts are inserted in alternate sequence.

In FIG. 9, relay contacts R1 to R4 in the driver circuit 20' are controlled by a relay sequence circuit of the manual weft selector PB' shown in FIG. 10. Relays R1 to R4 in FIG. 9 are activated by switches S1 to S4 in the manual weft selector PB'.

Dashed lines in FIG. 10 connecting switches S1 to S4 and SR in FIG. 10 indicate that contacts of these switches are mechanically coupled to each other. In the case of the illustrated example, manual operation exclusively closes one switch only. Once closed, the switch is mechanically kept closed until another switch is closed or the reset switch SR is closed.

During normal running of the loom, the switches S1 to S4 are kept open as shown in FIG. 10 and the relay contacts R1 to R4 are set as shown in FIG. 9. As a consequence, color signals C1 to C4 pass through the signal reservation circuit 300 so as to be issued in the form of output signals B1 to B4 via the relay contacts R1 to R4 in the driver circuit 20'. Wefts are inserted following a regular sequential weft selection pattern fixed by these output signals.

It is assumed that weft insertion of the weft W1 corresponding to the color signal C1 is now to be adjusted. The switch S1 in the manual weft selector PB' is first closed and, as the relay R1 is activated thereby, the relay contact R1 in the driver circuit 20' establishes a connection to a constant voltage source +V. Since the relay R5 is activated too, the relay contacts R5 in the signal reservation circuit 300 are all made open so that the color signals C1 to C4 from the automatic weft selector 40 are all blocked at the signal reservation circuit 300. Due to the connection of the relay contact R1 to the constant voltage source +V in the driver circuit 20', only the output signal B1 always assumes a H-level. As a consequence, only the weft W1 corresponding to this output signal B1 is repeatedly inserted in succession quite independently of the regular sequential weft selection pattern given by the automatic weft selector 40.

After adjustment of weft insertion is over, the reset switch SR is manually closed so that the switch S1 is opened. As a result, the connection to the constant voltage source +V is opened and the relay contact R1 in the driver circuit 20' resumes the condition shown in FIG. 9, i.e. the condition during the normal running of the loom.

In the case of the foregoing embodiment, relays are used for constructing the circuits. Another embodiment of the detailed construction of the weft inserting system is shown in FIG. 11, in which logic elements are used for construction circuits.

The signal reservation circuit 300 includes four sets of AND-gates and the driver circuit 20' includes four sets of OR-gates. The manual weft selector PB' includes five sets of switches S1 to SR and a NOR-gate connected in parallel to these switches.

During normal running of the loom, the color signals C1 to C4 are issued by the automatic weft selector 40 following a regular sequential weft selection pattern and each of them at a H-level is passed to the signal reservation circuit 300. Since the switches S1 to SR in the manual weft selector PB' are all left open at this moment, a signal at a H-level is issued by the NOR-gate. As a consequence, signals at H-levels are passed to both input ternals of each AND-gate in the signal reservation circuit 300. On receipt of corresponding signals from the signal reservation circuit 300, the driver circuit 20' issues the signals B1 to B4 in alternate sequence.

When weft insertion of the weft W1 corresponding to the color signal C1 is to be adjusted, only the switch S1 is closed in the manual weft selector PB' and the NOR-gate issues a signal at a L-level in response to an output signal from the constant voltage source +V. Thus, the signal reservation circuit 300 is blocked and issues a signal at a L-level. In the driver circuit 20', only the OR-gate corresponding to the output signal B1 receives a signal at a H-level corresponding to the output signal from the constant voltage source +V. As a consequence, the driver circuit 20' always issues the signal B1 only independently of the regular sequential weft selection pattern given by the automatic weft selector 40.

In accordance with the second aspect of the present invention, adjustment of weft insertion can be performed at any time required regardless the running condition of the loom.

We claim:

1. An insertion controller for selective insertion of different wefts on a fluid jet loom having an automatic weft selector and a driver circuit which controls the sequence of weft insertion following a regular sequential weft selection pattern fixed by commands from said automatic weft selector, comprising:

a signal reservation circuit interposed between said automatic weft selector and said driver circuit;

a control box for said loom and a manual weft selector, both connected to said signal reservation circuit and to said driver circuit;

said driver circuit including means for following said regular sequential weft selection pattern during normal running of said loom, and;

said driver circuit including means for following a free selective weft selection pattern when the loom is stopped, said free selective weft pattern being fixed by commands from said manual weft selector with priority to said regular sequential weft selection pattern.

2. An insertion controller as claimed in claim 1, further comprising means for shifting weft selection mode from said regular sequential weft selection pattern to said free selective weft selection pattern based on the state (H/L) of the output signal from said control box.

3. An insertion controller for selective insertion of different wefts on a fluid jet loom having an automatic weft selector and a driver circuit which controls the sequence of weft insertion following a regular sequential weft selection pattern fixed by commands from said automatic weft selector, comprising:

a signal reservation circuit interposed between said automatic weft selector and said driver circuit;

a manual weft selector connected to both said signal reservation circuit and said driver circuit; and, said driver circuit including means for following a free selective weft selection pattern when commands are issued from said manual weft selector, said free selective weft selection pattern being fixed by these commands with priority to said regular sequential weft selection pattern.

4. An insertion controller as claimed in claim 3, wherein said circuits are constructed with relays.

5. An insertion controller as claimed in claim 3, wherein said circuits are constructed with logic elements.

* * * * *